US007257859B2

(12) United States Patent
Nam et al.

(10) Patent No.: US 7,257,859 B2
(45) Date of Patent: Aug. 21, 2007

(54) CLEANER HAVING BRUSH

(75) Inventors: Hyeun Sik Nam, Seoul (KR); Yong Woo Lee, Seoul (KR); Ho-Seon Rew, Seoul (KR); Choon Myun Chung, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 609 days.

(21) Appl. No.: 10/720,113

(22) Filed: Nov. 25, 2003

(65) Prior Publication Data

US 2004/0221418 A1 Nov. 11, 2004

(30) Foreign Application Priority Data

May 7, 2003 (KR) ..... 10-2003-0029057

(51) Int. Cl.
*A47L 5/00* (2006.01)

(52) U.S. Cl. ..... 15/375; 15/376; 15/387

(58) Field of Classification Search ..... None
See application file for complete search history.

(56) References Cited

U.S. PATENT DOCUMENTS 6,079,079 A 6/2000 Oka

FOREIGN PATENT DOCUMENTS

JP 64-22225 1/1989

OTHER PUBLICATIONS

English Language Abstract of JP 64-22225.

*Primary Examiner*—David Redding
(74) *Attorney, Agent, or Firm*—Greenblum & Bernstein, P.L.C.

(57) ABSTRACT

A cleaner having a brush includes a suction motor mounted in a main body, and generating a suction force; a filter for collecting dust or filth sucked by the suction force generated at the suction motor; a suction head connected with the filter by a suction pipe, and having an inlet through which dust and filth on a floor are sucked; and a brush rotatably mounted at an inside of the suction head. The inlet is partitioned off into a first section and a second section by a belt cover for protecting a belt winding around the brush, and a flow passage unit is formed at the brush so that air can flow between the first and second sections. Accordingly, air can flow smoothly at a portion, which is blocked by the belt cover, and thus cleaning performance can be improved.

5 Claims, 8 Drawing Sheets

CLEANER HAVING BRUSH

BACKGROUND OF THE INVENTION

1. Field of the Invention

The present invention relates to a cleaner having a brush, and more particularly, to a cleaner capable of improving cleaning performance by smoothing a flow of air at a portion with a relatively weak suction force.

2. Description of the Background Art

FIG. 1 is a perspective view of an upright cleaner according to a conventional art, and FIG. 2 is a cross sectional view of an upright cleaner according to a conventional art.

The conventional upright cleaner includes a main body 102 disposed in a state of standing uprightly; a suction motor 104 mounted in the main body 102, and generating a suction force; a filter 106 disposed at a suction side of the suction motor 104, and collecting dust and filth sucked by the suction force generated at the suction motor 104; a filter container 108 in which the filter 106 is mounted; a suction head 110 disposed at a lower portion of the main body 102, and sucking dust and filth on a floor; and a brush 112 rotatably installed at the suction head 110, and cleaning a carpet.

A handle 114 is mounted at an upper portion of the main body 102, and a wheel for moving 118 is installed at a lower portion of the suction head 110.

In the suction head 110, a brush 112 rotatably mounted at its inside, an inlet 120 through which dust and filth on the floor are sucked, is formed at its lower portion, and a suction pipe 122 for guiding dust and filth sucked through the inlet 120 to the filter 106, is connected to its one side.

As shown in FIG. 3, both ends of the brush 112 are rotatably supported by the inside of the suction head 110 respectively, and the brush 112 is rotated by receiving a rotating force of the suction motor 104. That is, a driven pulley 130 is formed at one side of the brush 112, and a driving pulley 132 is mounted at a rotation shaft 126 of the suction motor 104. The driving pulley 132 and the driven pulley 130 are connected to each other by a belt 134, and thus the brush 112 is rotated when the suction motor 104 is driven. And, a belt cover 140 for protecting the belt 132 is mounted at the suction head 110.

In the conventional upright type cleaner constructed as above, when the suction motor 104 is driven and thus a suction force is generated, dust and filth on a floor are sucked into the suction head 110 through the inlet 120, and the dust and filth flowed into the suction head are collected at the filter 106 along the suction pipe 112.

When the rotation shaft 126 of the driving motor 104 rotates, a driving pulley 132 is rotated, and thus the driven pulley 130 connected with the driving pulley 132 by the belt 134, is rotated. When the driven pulley 130 is rotated, the brush 112 at which the driven pulley 130 is formed, is rotated and thus cleans a carpet during its rotation.

However, as shown in FIG. 4, in the conventional upright cleaner, a certain section (T) at a right portion of the inlet 120 is blocked by the belt cover 140 for protecting the belt 134. Therefore, at the section (T), a suction force for sucking dust and filth on the floor is not occurred so that cleaning performance is deteriorated.

That is, as shown in FIG. 4, a flow of air sucked through the inlet 120 is induced into the suction pipe 112, having a flow form like an arrow P because of rotation of the brush 112. At this time, since a certain section (T) of the inlet 120 is blocked by the belt cover 140, a flow of air is cut off at the section (T) and thus suction force is not occurred.

SUMMARY OF THE INVENTION

Therefore, an object of the present invention is to provide a cleaner having a brush capable of improving its cleaning performance by forming a flow passage at a brush so that flow of air can be smoothed at a portion blocked by a belt cover.

To achieve these and other advantages and in accordance with the purpose of the present invention, as embodied and broadly described herein, there is provided a suction motor mounted in a main body, and generating a suction force; a filter for collecting dust or filth sucked by the suction force generated at the suction motor; a suction head connected with the filter by a suction pipe, and having an inlet for sucking dust and filth on a floor; and a brush rotatably mounted at the inside of the suction head.

The inlet is partitioned into a first section and a second section by a belt cover for protecting a belt winding around the brush, and a flow passage unit formed at the brush so that air can flow between the first section and the second section.

The brush includes a cylindrical brush hub; brush hair mounted at an outer circumferential surface of the brush hub; and a flow passage unit formed at the brush hub so that air can flow between the first section and the second section of the inlet, which is partitioned off by the belt cover.

The flow passage unit of the brush includes a diameter-reduced portion where a diameter at both sides of the driven pulley around which the belt winds are reduced respectively; an exposed surface formed at both sides of the driven pulley by the diameter-reduced portion respectively; and a flow passage penetrating the exposed surface.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, one embodiment of a suction apparatus of a cleaner according to the present invention will now be described with reference to the accompanying drawings.

There can be a plurality of embodiments as one embodiment, but the preferred embodiment will now described.

Figure 1:
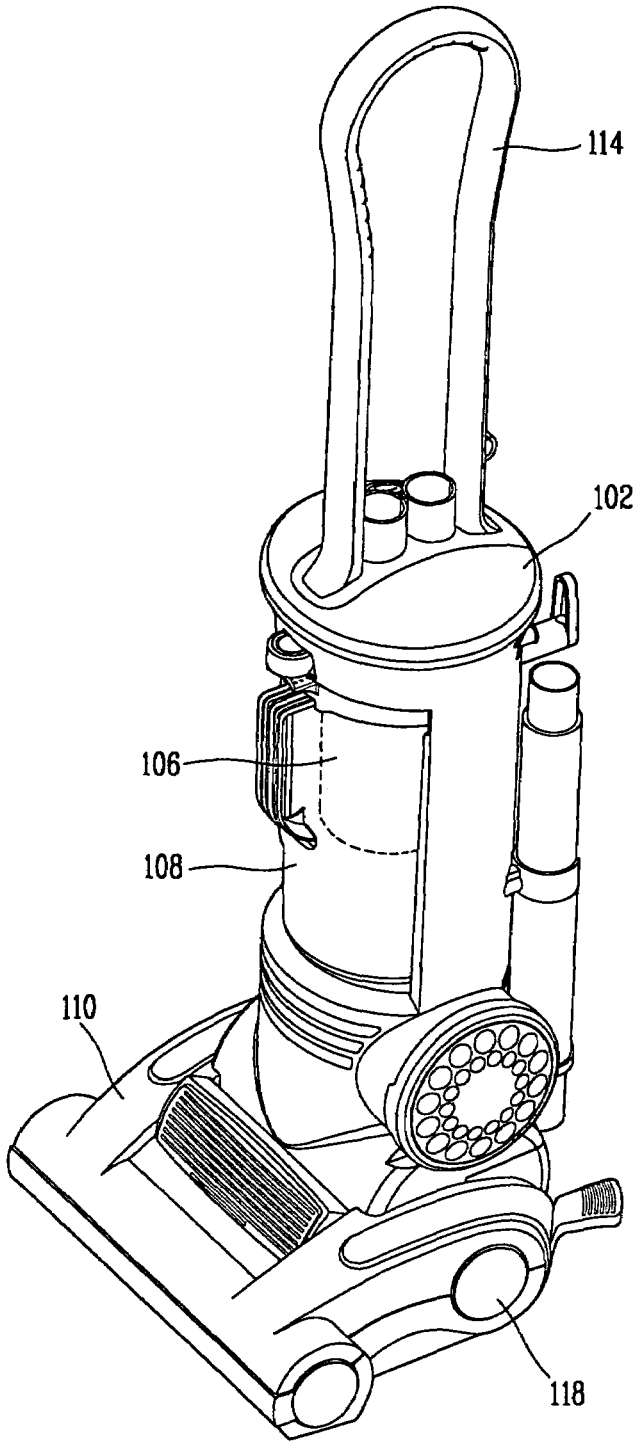
FIG. 1 CONVENTIONAL ART
FIG. 1 is a perspective view of an upright cleaner according to the conventional art.
Figure 2:
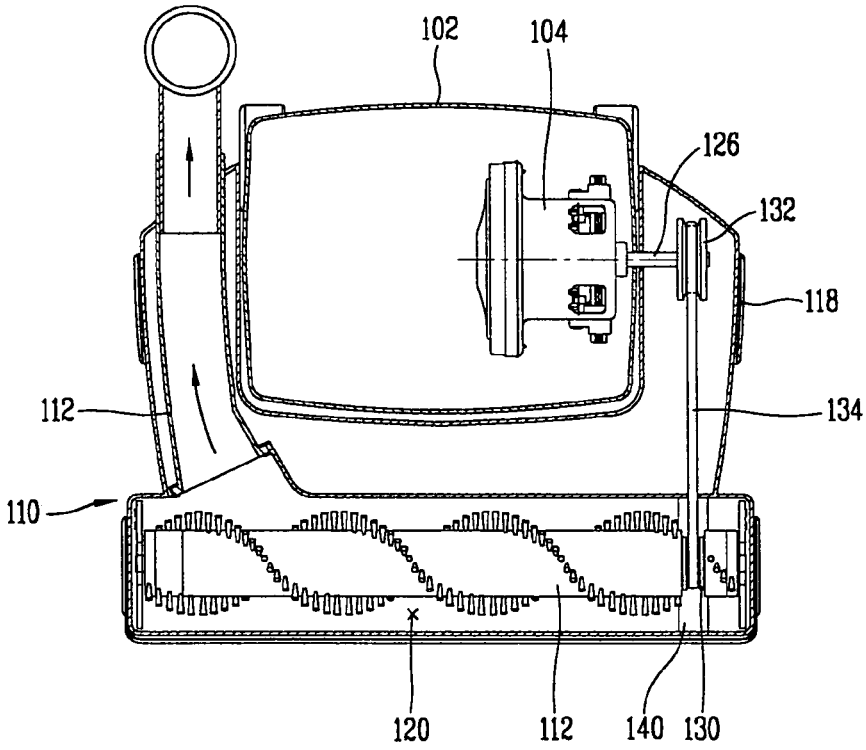
FIG. 2 CONVENTIONAL ART
FIG. 2 is a cross sectional view of an upright cleaner according to the conventional art.
Figure 3:
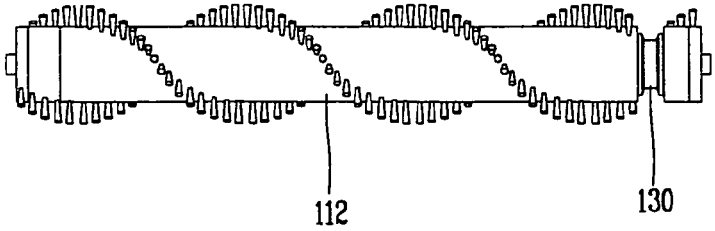
FIG. 3 CONVENTIONAL ART
FIG. 3 is a side view of a brush according to the conventional art.
Figure 4:
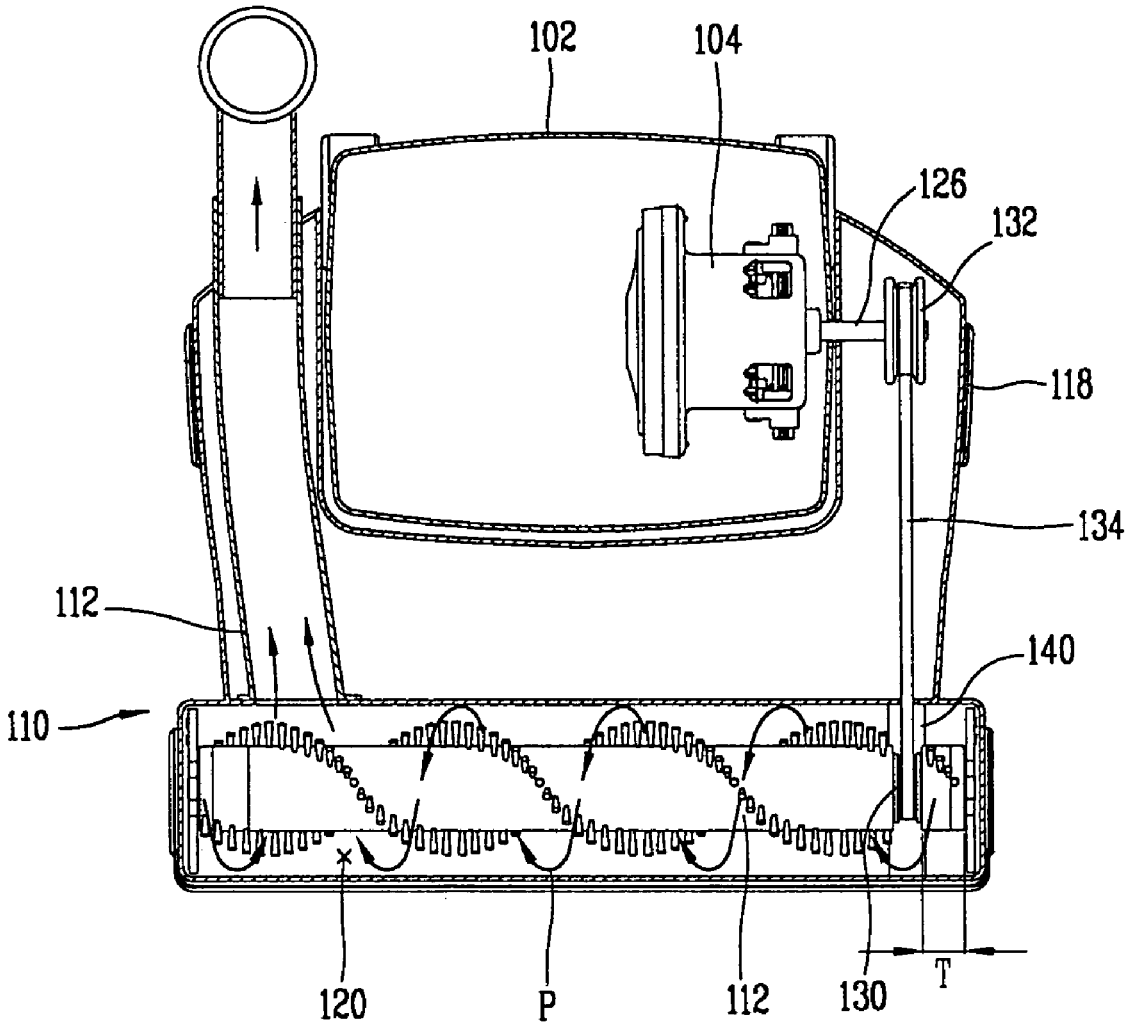
FIG. 4 CONVENTIONAL ART
FIG. 4 is an operation state view of an upright cleaner according to the conventional art.
Figure 5:
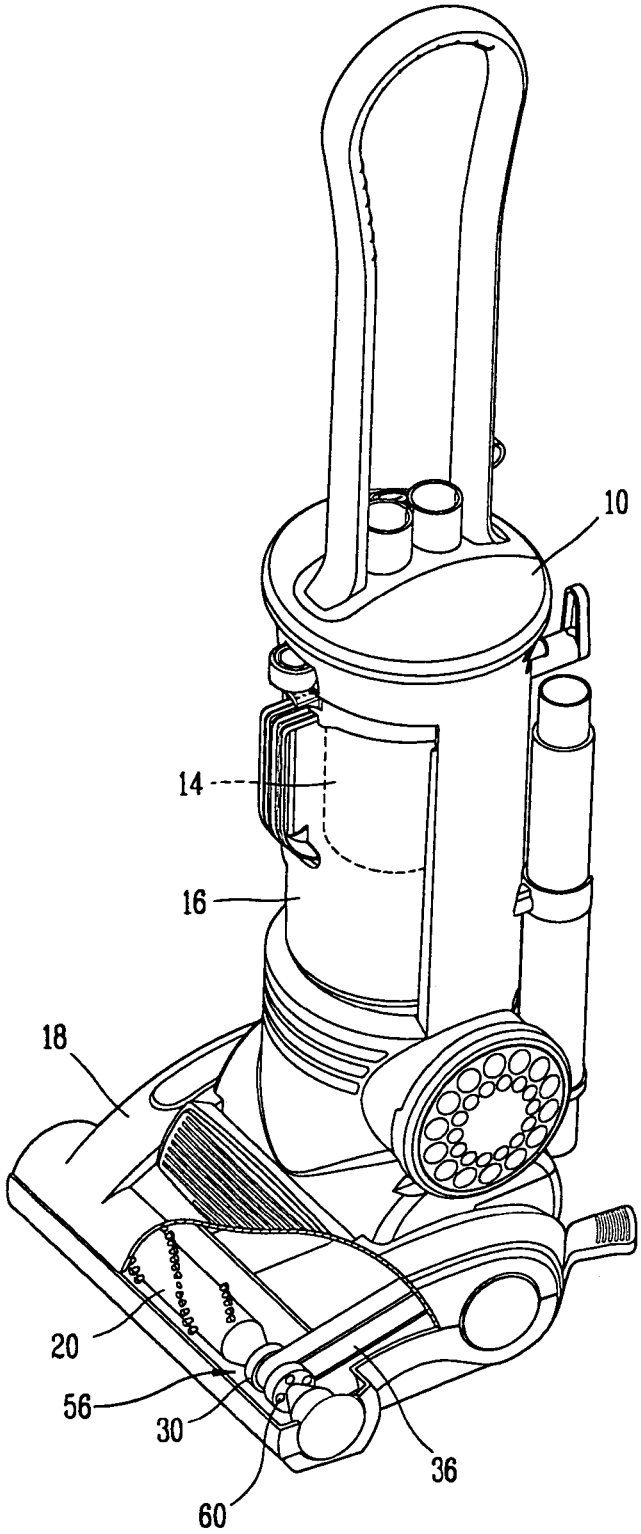
FIG. 5 is a perspective view of an upright cleaner according to the present invention.
Figure 6:
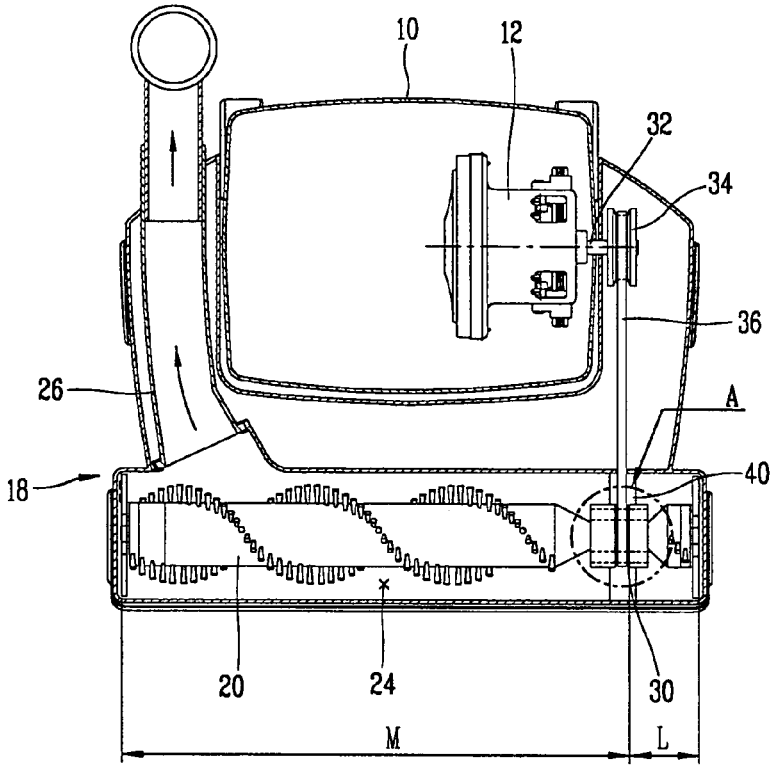
FIG. 6 is a cross sectional view of an upright cleaner according to the present invention.

FIG. 5 is a perspective view of a cleaner according to one embodiment of the present invention, and FIG. 6 is a cross sectional view of a cleaner according to one embodiment of the present invention.

A cleaner according to the present invention includes a main body 10 disposed in a state of standing uprightly; a suction motor 12 mounted in the main body 10, and generating a suction force; a filter 14 disposed at a suction side of the suction motor 12, and collecting dust and filth sucked by the suction force generated at the suction motor 12; a filter container 16 in which the filter 14 is mounted; a suction head 18 disposed at a lower portion of the suction motor 12, and sucking dust and filth on a floor; and a brush 20 rotatably installed at the suction head 18, and cleaning a carpet or sweeping up dust and filth on the floor into the suction head 18.

In the suction head having a certain space in which dust and filth can be flowed, an inlet 24 where dust and filth are sucked, formed at its lower portion, a suction pipe 26 for inducing dust and filth sucked into the inlet 24 to the filter 14 is connected to its one side, and a brush 20 is rotatably installed at its inside.

A driven pulley 30 is formed at one side of the brush 20, a driving pulley 34 is mounted at a rotation shaft 32 of the suction motor 12, and a belt 36 winds around between the driven pulley 30 and the driving pulley 34. Accordingly, if the rotation shaft 32 of the suction motor 12 is rotated, the driving pulley 34 is rotated, the driven pulley 30 is rotated by the belt 30, and thus the brush 20 is rotated.

Herein, at one side of the inlet 24 of the suction head, a belt cover 40 for protecting the belt 36 is mounted. Since this belt cover 40 is mounted at the inlet 24 in order to prevent the belt 36 from being exposed to the outside, the inlet 24 is partitioned off into two parts due to the belt cover 40. That is, the inlet 24 is partitioned off into a first section (M) where the suction pipe 26 is connected, and thus a strong suction force is occurred, and a second section (L) where a relatively weak suction force is occurred since blocked by the belt cover 40.

Figure 7:
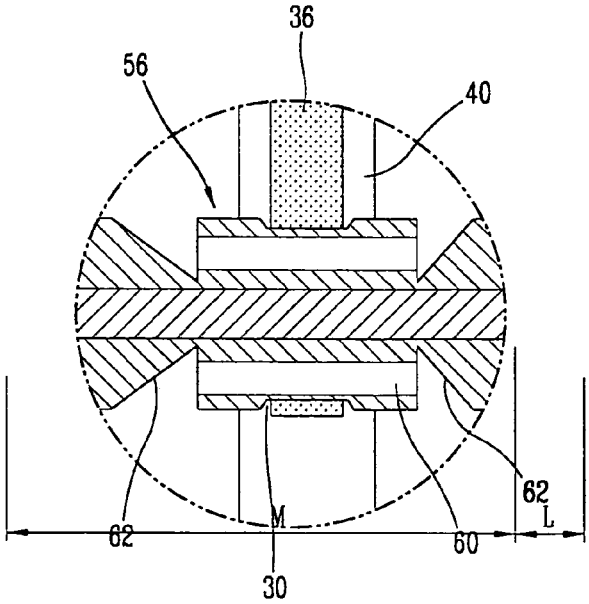
FIG. 7 is an enlarged sectional view of a part A of FIG. 6.
Figure 8:
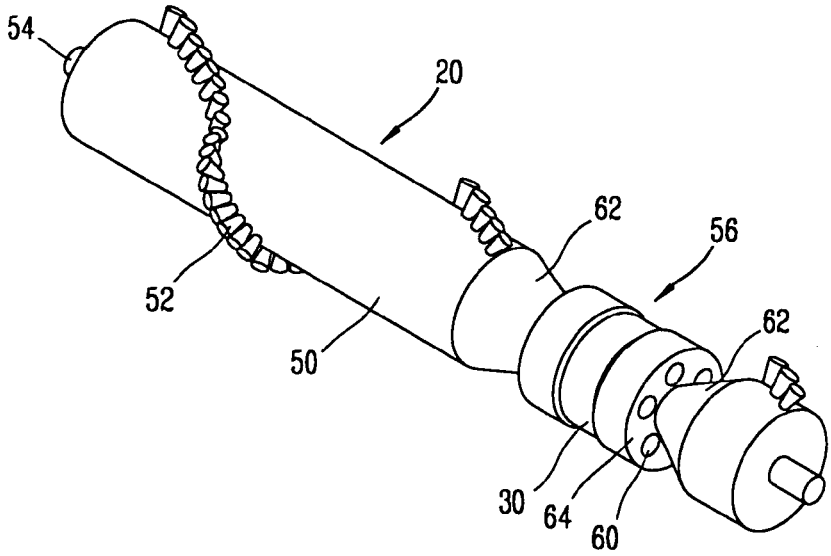
FIG. 8 is a perspective view of a brush assembly according to one embodiment of the present invention.

As shown in FIGS. 7 and 8, the brush 20 includes a cylindrical brush body 50; brush hair 52 mounted at an outer circumferential surface of the brush body 50, and brushing up the dust of the carpet or sweeping up the dust and foreign substances on the floor; and a hinge shaft 54 formed at both end portions, and rotatably supported by the inside of the brush body 50. At the brush body 50, a flow passage unit 56 for making the first section (M) and the second section (L) communicating is formed so that air can flow between both sections (M and L).

Figure 9:
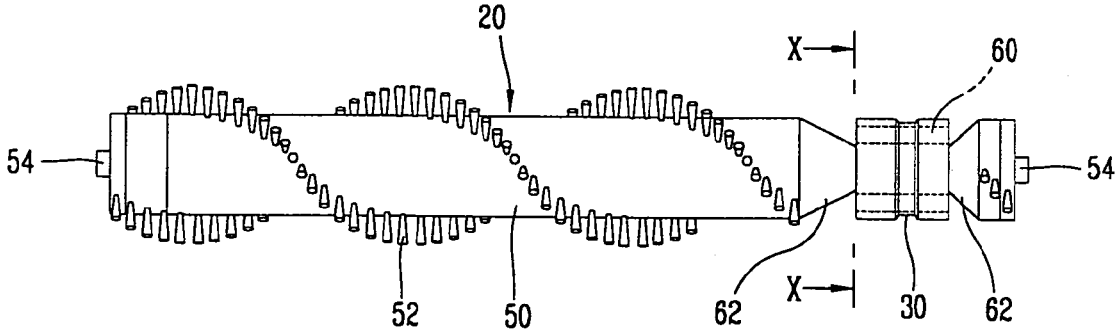
FIG. 9 is a side view of a brush assembly according to one embodiment of the present invention.
Figure 10:
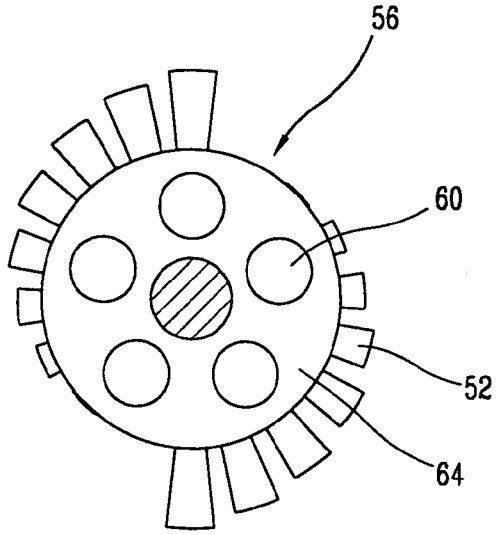
FIG. 10 is a sectional view taken along line X-X of FIG. 9.

As shown in FIGS. 9 and 10, the flow passage unit includes a flow passage 60 penetrating the brush body 50 at a portion at which the driven pulley 30 of the brush body 50 is formed, that is, at which the belt cover 40 is mounted; and a diameter-reduced portion 62 formed so that a diameter of the brush body 50 becomes smaller.

In other words, a diameter-reduced portion 62 is formed at both sides of the driven pulley 30 respectively, thusly, an exposed surface 62 exposed outside is formed at both sides of the driven pulley 30, and the flow passage 60 penetrates between both exposed surfaces.

Herein, preferably, the diameter of diameter-reduced portion 62 becomes smaller, as approaching the exposed surface 64 of the driven pulley 30. And, the flow passage 60 penetrates between both exposed surfaces, and formed in plural circular forms at a certain interval therebetween in a circumferential direction.

Operations of the cleaner according to the present invention constructed as above will now be described.

Figure 11:
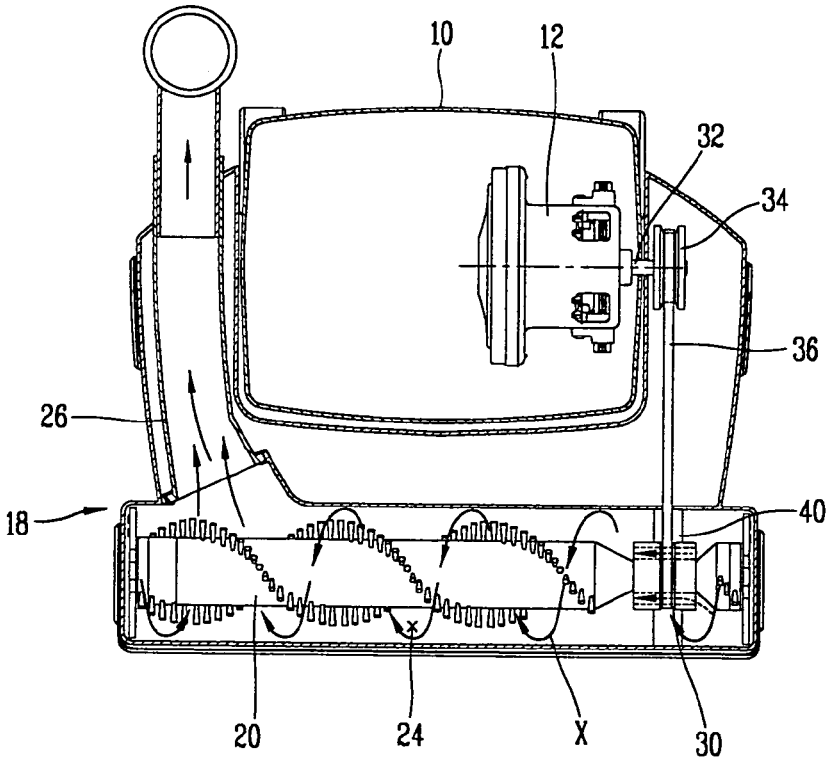
FIG. 11 is an operation state view of a brush assembly according to one embodiment of the present invention.

FIG. 11 is an operation state view of a cleaner according to the present invention.

When a suction motor 12 is driven by an operation of a user, a suction force is generated. Then, dust and filth on a floor are sucked through an inlet 24 of the suction head 18, and are collected into the filter 14 along the suction tube 26.

While rotating, the brush 20 brushes up the dust of a carpet or sweeps up dust or oil on a floor into the suction head 18. That is, when a rotating shaft 32 of the driving motor 12 is rotated, the driving pulley 34 mounted at the rotation shaft 32 is rotated, the driven pulley 30 connected with the driving pulley 34 by the belt 36 is rotated and thus rotates the brush 20.

Herein, in the inlet 24, a first section (M) and a second section (L) partitioned by the belt cover 40 communicates with each other so that air can flow between both sections through the flow passage 60 formed at the brush hub. For this reason, a strong suction force is occurred at the second section (L) too, and thus dust and foreign substances on a floor are smoothly sucked and flowed into the first section (M) through the flow passage 6. At this time, the dust and foreign substances are flowed into the suction pipe 26, flowing with a flow form like an arrow X.

Figure 12:
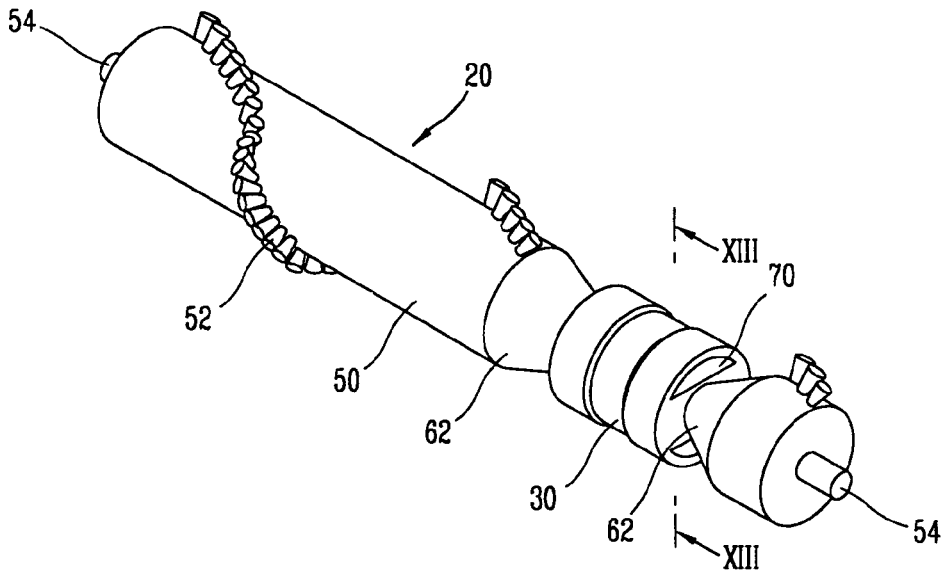
FIG. 12 is a perspective view of a brush assembly according to another embodiment of the present invention.
Figure 13:
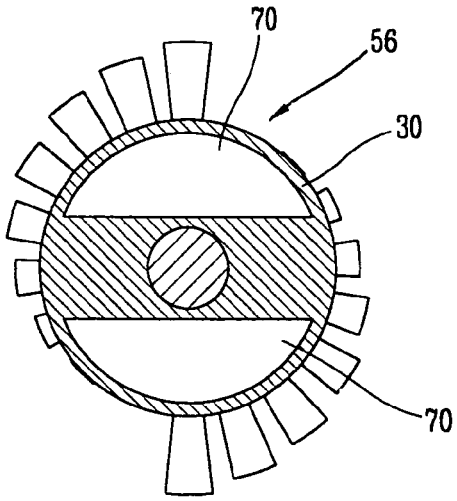
FIG. 13 is a sectional view taken along line XIII-XIII of FIG. 12.

FIGS. 12 and 13 are a perspective view and a sectional view showing a brush of a cleaner according to another embodiment of the present invention respectively.

The brush 20 according to another embodiment has the same structure as the brush according to one embodiment described above, except the shape of a flow passage 70.

That is, a flow passage 70 is oppositely formed in two semicircular forms at a brush hub 50. Since, the flow passage 70 according to another embodiment has a bigger size than the flow passage 60 according to one embodiment, a flow of air can be greater so that a stronger suction force can be occurred at the second section (L) of the inlet 24.

Effect of a cleaner having a brush according to the present invention constructed and operated as described above will now be described.

A flow passage is formed at a brush hub corresponding to a portion at which a belt cover is mounted so that a first section and a second section, which are blocked by the belt cover, can communicate with each other. Accordingly, a suction force occurred at the second section increases, and thus cleaning performance can be improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A cleaner comprising:

a suction motor mounted in a main body, and generating a suction force;

a filter that collects dust or filth sucked by the suction force generated at the suction motor;

a suction head connected with the filter by a suction pipe, and having an inlet through which dust and filth on a floor are sucked; and a brush rotatably mounted at an inside of the suction head;

wherein, the inlet is partitioned into a first section and a second section by a belt cover that protects a belt winding around the brush, and a flow passage unit is formed at the brush so that air can flow between the first section and the second section, and wherein the flow passage unit comprises:

a reduced-diameter portion where a diameter at opposite sides of a driven pulley around which the belt winds is reduced, respectively;

an exposed surface formed at each side of the driven pulley by the diameter-reduced portion; and at least one flow passage penetrating the exposed surface.

2. The cleaner of claim 1, wherein the brush comprises:

a cylindrical brush hub;

brush hair mounted at an outer circumferential surface of the brush hub; and the flow passage unit is formed at the brush hub so that air can flow between the first section and the second section of the inlet, which is partitioned by the belt cover.

3. The cleaner of claim 2, wherein the diameter of the reduced-diameter portion becomes smaller toward the exposed surface of the driven pulley.

4. The cleaner of claim 2, wherein the flow passage is formed in plural circular forms with an interval therebetween in a circumferential direction.

5. The cleaner of claim 2, wherein the flow passage is formed in a semicircular form at the exposed surface.

* * * * *